US007141287B2

(12) United States Patent
Blessing

(10) Patent No.: US 7,141,287 B2
(45) Date of Patent: Nov. 28, 2006

(54) LUMINOUS COUNTERTOP

(76) Inventor: Ronald Lee Blessing, P.O. Box 923, Dallas, OR (US) 97338

( * ) Notice: Subject to any disclaimer, the term of this patent is extended or adjusted under 35 U.S.C. 154(b) by 122 days.

(21) Appl. No.: 10/368,136

(22) Filed: Feb. 20, 2003

(65) Prior Publication Data

US 2004/0166291 A1 Aug. 26, 2004

(51) Int. Cl.
*B32B 3/10* (2006.01)

(52) U.S. Cl. ..... 428/44; 428/41; 428/51; 428/319.7; 428/690; 156/228; 156/309.6; 156/182; 156/212; 52/783; 52/813; 252/301.36

(58) Field of Classification Search ..... 428/690, 428/44, 41, 51, 319.7; 156/8, 228, 309.6, 156/182, 212; 52/8, 783, 813, 301.36
See application file for complete search history.

(56) References Cited

U.S. PATENT DOCUMENTS 3,077,012 A * 2/1963 Speraw ..... 52/782.22
5,310,435 A * 5/1994 Kelly ..... 156/182
5,567,745 A * 10/1996 Minghetti et al. ..... 523/202
5,595,427 A * 1/1997 Peters et al. ..... 312/140.4
5,695,696 A 12/1997 Hensler et al.
6,113,199 A * 9/2000 Foote ..... 312/140.3
6,183,585 B1 2/2001 Kelley
6,207,077 B1 * 3/2001 Burnell-Jones ..... 252/301.36
6,309,501 B1 * 10/2001 Kelley ..... 156/257
6,395,408 B1 5/2002 Nelson et al.
6,500,543 B1 12/2002 Sakai
6,743,327 B1 * 6/2004 Schober ..... 156/309.6

* cited by examiner

*Primary Examiner*—Rena Dye
*Assistant Examiner*—Tamra L. Dicus
(74) *Attorney, Agent, or Firm*—Carl D. Crowell

(57) ABSTRACT

A countertop and method of countertop manufacture wherein the countertop has a horizontal surface and a vertical edge surface wherein the vertical edge surface is comprised of at least one luminescent component. The luminescent component being of a solid surface material with a luminescent quality.

9 Claims, 2 Drawing Sheets

Fig. 1
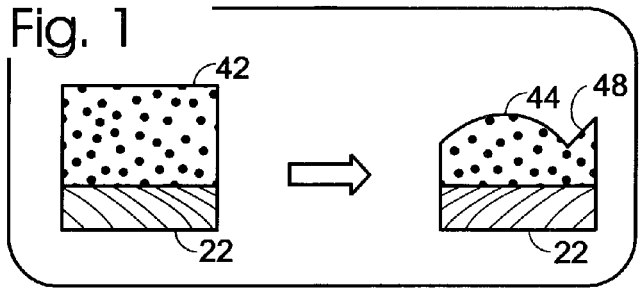
Fig. 2
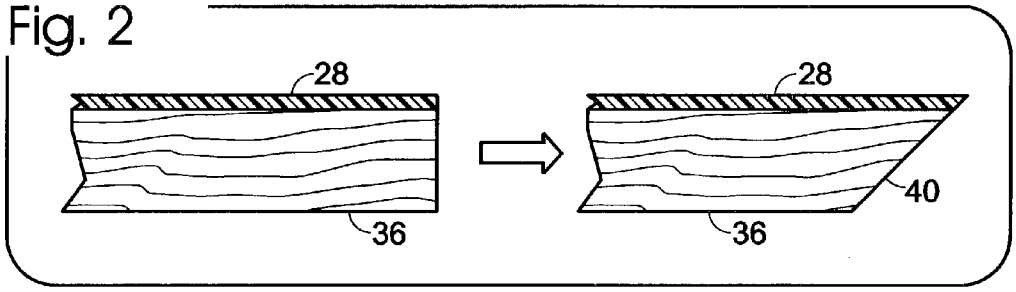
Fig. 3
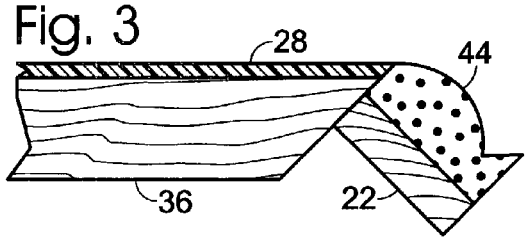
Fig. 4
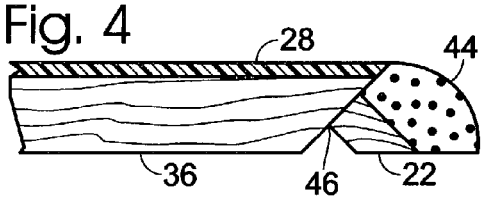
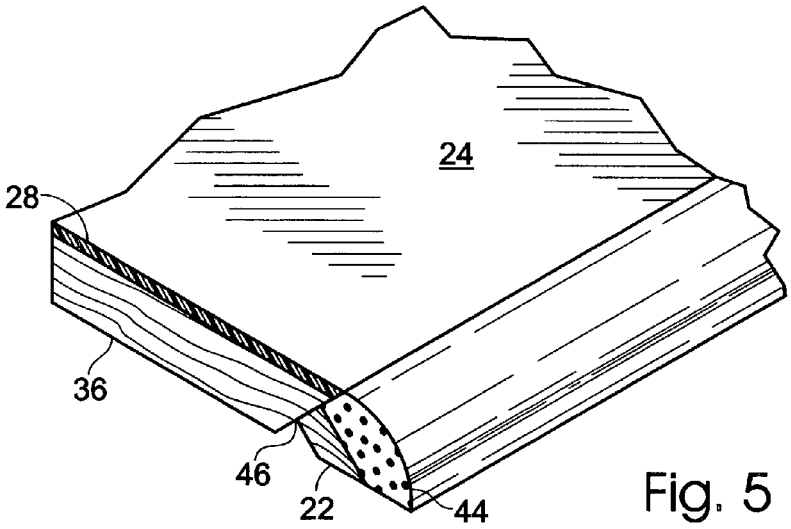
Fig. 5

LUMINOUS COUNTERTOP

BACKGROUND

This invention relates to countertops utilizing solid surface or artificial stone material and specifically to a method of manufacturing solid surface countertops incorporating a luminous, phosphorescent or light-emitting property which is useful for both decorative aspects and as a direction indicator or a position guide using light in dark surroundings.

Solid surface countertop material or artificial stone obtained by pulverizing a natural stone or using a similar artificial filler and mixing the pulverizate with a resin or the like for solidification is well known. Such products are sold under the Dupont® trade name CORIAN® and commonly available. Synthtic solid surface components are available in a wide degree of colors and may be manufactured to resemble natural stone such as marble, granite or the like or may be completely synthetic in appearance to match a unique décor.

As an approach to improve properties and a performance of solid surface materials, there have been attempts to impart a light function using a luminous material such as a luminescent material or a fluorescent material such as an ultraviolet light-emitting material which emits light through ultraviolet absorption. This approach is conducted by mixing a fluorescent material with a resin component as a binder of an artificial stone for solidification or by mixing a luminescent fluorescent material such as zinc sulfide compounds commonly available and sold under the trade name PYLAM PHOSPHORESCENCE, by PYLAM Products, of Tempe Ariz., and using the resulting product as an aggregate to form an artificial stone. Additional methods and mixtures of forming luminescent solid surface material are disclosed in U.S. Pat. No. 6,500,543 to Sakai, incorporated herein.

However, the production of luminescent solid surface material is generally not cost effective. A fluorescent material such as a luminescent material or the like is very expensive, and even the addition of the same in a small amount increases the overall cost to from 3 to 10 times. Accordingly, the ordinary artificial stone containing a fluorescent material free from this function was not practical in view of the cost.

The principal failing of the production of luminescent solid surface material is that only a small portion of the material near the surface gives the fluorescent function and the luminescent material contained in the balance of the solid surface product does not provide any luminescence. The result is to create a luminescent solid surface material of a usable thickness, the majority of the luminescent material is not utilized resulting in significant incurred production costs without realizing benefit.

Generally the desired effect is not to use the luminescent solid surface as a light source, but only as a decorative guide, indicator or outline. In a kitchen or bathroom or similar application, it is useful and desirable to know the location of counters and surfaces to avoid injury at night or in the dark. It is desirable to be able to enter into a room at night and be able to determine the location of counters or surfaces without turning on area lights.

Other methods of providing luminescent guides or indicators in solid surface materials have been disclosed, however the prior art fails to meet the needs met by the disclosed invention.

U.S. Pat. No. 6,500,543 to Sakai discloses a method of providing grooves or protrusions in a traditional solid surface and filling these grooves or the spaces between the protrusions with the more expensive luminescent solid surface material. Sakai requires that solid surface material be formed with a complex surface, or machined to a complex surface to contain the luminescent solid surface material to be added. The pouring and curing of luminescent solid surface material also adds to the complexity of any installation as additional finishing of the surface will be required after the addition of the luminescent solid surface material.

Also known are decorative laminates incorporating luminescent materials, such as disclosed in U.S. Pat. No. 6,395,408 to Nelson, et al. While the incorporation of laminate surfaces into countertops utilizing solid surface materials is known, laminate material is considered by many to be an inferior product and limited in how it may be molded, being restricted to largely planar surfaces and limited curvature.

What is desired and herein provided is an improved product and improved method of manufacture which provides for decorative and useful incorporation of luminescent solid surface material into countertops. Provided is a method and product which utilizes luminescent solid surface material on borders of countertops and in a thickness which provids for full utility and reduced costs.

Countertops have a horizontal surface that forms the working portion of the countertop, and a vertical surface that generally corresponds to the thickness of the countertop and is readily visible. A solid surface corner element is located between the horizontal and vertical surface element generally with an arcuate or radiused finished surface that fairs into both pieces of laminate. If desired, a second arcuate corner element, similar to the first corner element, can be placed at the lower corner of the vertical surface to give a more rounded appearance.

The specific improvements of the present invention relate to the utilization of luminescent solid surface material only in the vertical surface element or in the alternative, utilizing luminescent solid surface material only in one or more corner elements. Further improvements over the prior art include the mounting of thinner pieces of the expensive luminescent solid surface material to a less expensive backer material for cost savings and to facilitate bonding of the components.

SUMMARY OF THE INVENTION

In one embodiment, provided is a countertop comprising a horizontal surface, generally of solid surface or laminate material. Exposed around the open parameter of the horizontal surface is a vertical edge of the thickens of the horizontal surface. The present invention utilizes a vertical edge piece comprised of luminescent solid surface material in strips of a length approximating the length of the exposed vertical edge of the horizontal surface affixed to the vertical edge of the horizontal surface by glue or similar means. The upper and lower corners of the luminescent solid surface vertical edge piece material may be finished with a rounded or arcuate surface if desired.

Further benefits of the invention may be realized with the utilization of a wood or wood substitute backer affixed to the luminescent solid surface material to permit thinner luminescent solid surface material to be used in construction.

In an alternate embodiment, the vertical edge piece is comprised of at least one corner element and a vertical face piece. To fabricate a corner element, a relatively narrow strip of luminescent solid surface material component is preferably mounted on a backer of wood or wood product material to permit the use of thinner solid surface material than would normally be needed, resulting in cost savings. An arcuate or radius surface is cut into the strip of luminescent solid surface material. This cut may be of any arc, but will generally be 90 degrees or greater and later finished to 90 degrees to effect a square corner.

A vertical face piece is formed and comprised of a strip of laminate surface, solid surface or luminescent solid surface material of the aproximate length of the corner element. If luminescent solid surface material is used in the face piece, it will be preferable to utilize a thin layer mounted to a substrate. The mounted piece has at least one edge cut at an angle to permit the corner element comprised of luminescent solid surface component to be glued to the vertical laminate piece. The tangent of the arc of the luminescent solid surface component at the point of the joining resides within or near the plane of the vertical laminate piece surface. The back of the vertical face piece substrate and the now joined solid surface corner element create a joined vertical edge piece. The joined vehicle edge piece is then finished by removing all overhang portions of the corner element permitting a flush mounting to the face of the horizontal laminate work surface or countertop.

In a preferred embodiment of the invention, a groove is retained in the base of the vertical face piece and the joined luminescent solid surface corner element to facilitate gluing. The verticle edge piece may also be finished such that the tangent of the arc of the remaining solid surface edge is just greater than 90 degrees to provide a higher degree of finish on joining to the horizontal laminate piece to joined edge piece.

If desired, a second corner element may be joined to the lower edge of the vertical face piece to provide rounded corner elements on both the upper and lower edge of the vertical face piece.

Accordingly, it is a principal object of the present invention to provide for the improved manufacture of a countertop having a luminescent edge or border.

It is a further object of the subject invention to lower production material costs by reducing the amount of luminescent solid surface component necessary.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIGS. 1–4 are a series of cross-sectional views showing the sequence of construction of the edge piece of the countertop.

FIG. 5 is a perspective view of the finished edge piece of the countertop.

PREFERRED EMBODIMENT OF THE INVENTION

Figure 6:
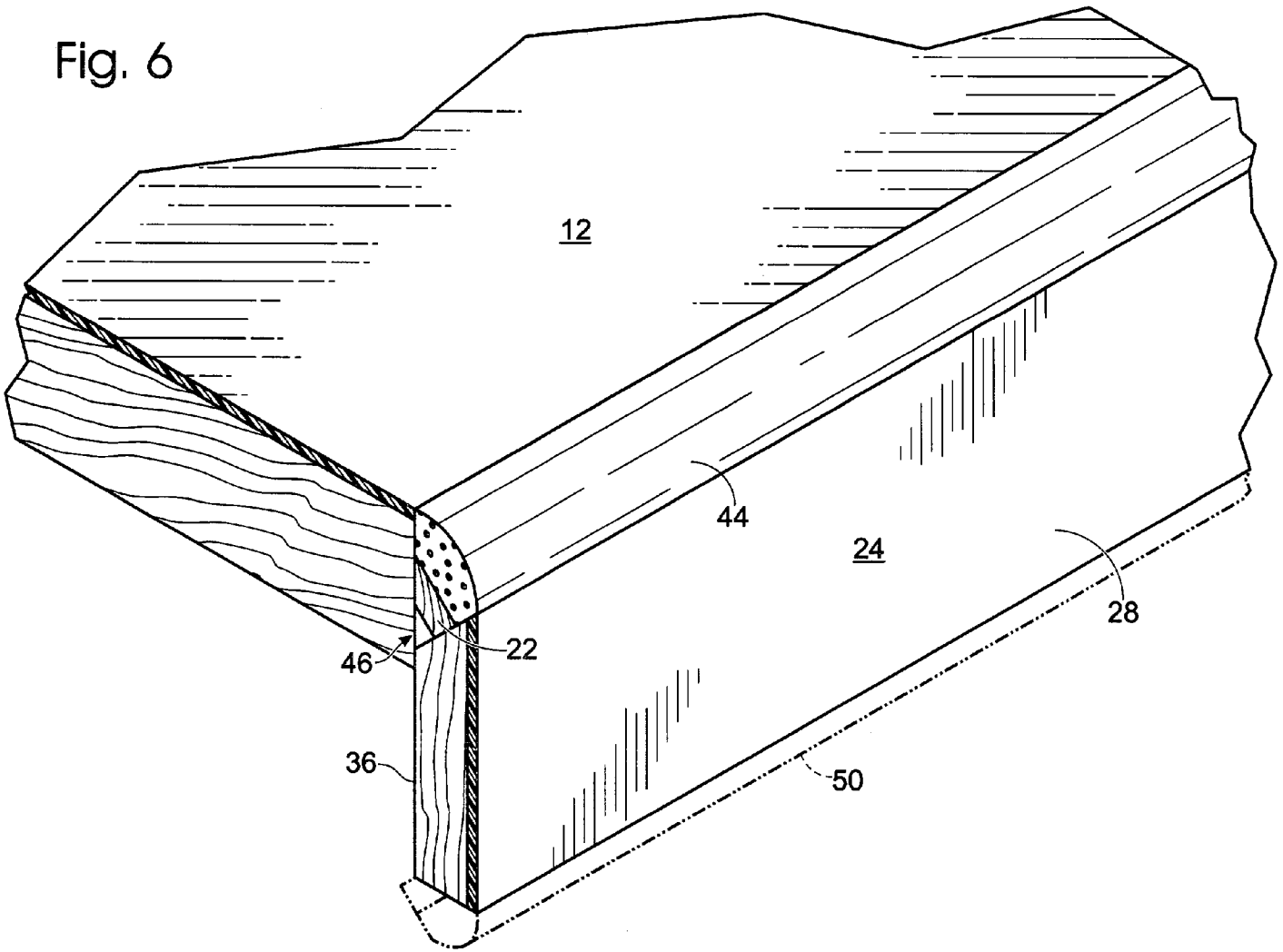
FIG. 6 is a perspective view of a countertop embodying the subject invention.

Countertops of this type are commonly used on kitchen cabinets and similar structures. However, the invention can also be utilized with decks made from veneer covered wood or similar materials, such as is used on tables, desks, and other furniture items.

Referring to the drawings, the various components involved with the method of the invention retain their indicators throughout the figures. The invention relates to the process of finishing a horizontal surface 12 with an exposed vertical edge with a vertical surface comprised of a joined vertical edge piece 24 and a rounded or arcuate solid surface corner element 44. The improvements of the present invention being the incorporation of luminescent solid surface material into one or more of the vertical surface components.

Luminescent solid surface material is well known in the art. The failings of prior utilization have been in the extreme costs of the luminescent components and the volumes needed for utility. There are a wide variety of solid surface materials which may be utilized with the addition of a luminous component in manufacture. In the preferred embodiment, the luminous solid surface material is comprised of approximately 63% by weight Aluminum Trihydrate filler such as is sold under the trade name Gtantex®, from Gruber Systems of Valencia, Calif. and 37% by weight bonding compound, the bonding compound comprised of a polyester resin such as Polylite® manufactured by Reichhold, Inc., and a luminescent compound such as Pylam Phosphorescence sold by Pylam Products mixed to a ratio of approximately 36-1 by weight. The resulting bonding compound with luminescence is mixed with the filler and catalyzed with an organic peroxide catalyst. Though the preferred mixture is disclosed, useful luminescent solid surface may be fabricated with up 16% by weight of luminescent compound. Higher percentages of luminescent compound create greater luminescence, though with significant greater costs.

The horizontal surface 12 in most countertops such as will be utilized with the invention are comprised of a sheet of laminate or veneer mounted on a base of wood or wood substitute or of a solid surface material, natural or synthetic. Generally the horizontal surface is bounded on all sides by exposed vertical edge.

Referring to FIGS. 1–3 of the drawings, a length of luminescent solid surface component 42 preferably affixed to a wood or wood substitute backer 22. The desired curved edge is then fabricated by finishing an arc into the upper surface of a solid surface component 42, forming an arcuate solid surface corner element 44 with a desired arc. This arc may be formed by any number of shaper means, including but not limited to high speed rotating blades such as are commonly used in routers. The finished arc is preferably greater than 90 degrees with a later removed clamping lip 48 that may be left to facilitate gluing. At a later step, this component is cut to or near 90 degrees.

The vertical edge piece 24 is made from an elongate rectangular cross-sectioned face piece which may be comprised of laminate mounted on wood or wood substitute substrate, solid surface material, or luminescent solid surface material 36 which has approximately the same height as the desired vertical edge piece 24, FIG. 2. At least one edge is mitered, or cut to a desired angle, to form a beveled angle face 40.

The arcuate luminescent solid surface corner element 44, is affixed to the beveled angle face 40 to form the vertical edge piece 24. The surfaces are aligned and secured by means such as glue. Additional clamping stability is provided with the retention of a clamping lip 48 when the arcuate surface is cut. While an arcuate solid surface component 44 may be utilized without a backer 22, an improvement of the present preferred embodiment is the providing of a wood or wood substitute backer 22 which may be bonded to a wood or wood substitute substrate 36. Solid surface thermoplastic material requires special care when gluing, often requiring special glues and increased bond times. Permitting two wood type surfaces such as backer 22 and substrate 36 to be joined in the bond greatly facilitates and speeds assembly.

The back side of the edge piece 24 and the overhanging portions of the solid surface component 42 and backer 22 are cut to form a finished edge piece 24 that is to be affixed to the exposed vertical edge of the horizontal surface 12. In a preferred embodiment, shown in FIGS. 1 and 5, a groove 46 is retained in the back side of joined edge piece 24. This provides a groove 46 for receiving any extra glue both in the bonding of the solid surface corner element 44 to the bevel angle face 40 and the later bonding of the joined edge piece 24 to the horizontal surface 12.

In the finishing of the vertical edge piece 24 it is disclosed and preferable that it be finished such that the vertical face surface 28 and back of the substrate 36 be a few degrees of parallel. Preferably the thickness of the joined edge piece 24 along the edge with the solid surface component 42 is slightly thicker than the balance of the joined edge piece 24 to facilitate creating a smooth edge when bonded to the exposed vertical edge of the horizontal surface 12.

Alternate Embodiment of the Invention

In an alternate embodiment of the invention, shown in dashed line, FIG. 6, a second corner element 50 may be glued to the joined edge piece 24 to provide rounded corners both at the intersection of the horizontal surface 12 and at the distal or lower edge of the joined edge piece 24.

The versatility of the present invention permits luminescent solid surface to be utilized in any combination of corner elements and face pieces, such that for nominal cost, luminescent solid surface material may be limited to use in only the first or upper corner element, or may be used in the first upper and second or lower corner elements, if a second corner element is fabricated. Other embodiments include the use of luminescent solid surface in the vertical face with or without a backer.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A countertop comprising:

(a) a horizontal surface with an exposed vertical edge;

(b) a vertical face element affixed to a substrate having a length substantially equal to said exposed vertical edge;

(c) a first corner element comprised of a luminous solid surface component with a finished shaped surface affixed to a backer, said first corner element having a length substantially equal to said exposed vertical edge;

(d) a vertical edge piece comprising said vertical face element and substrate affixed to said first corner element;

(e) wherein said vertical edge piece is affixed to said exposed vertical edge of said horizontal surface.

2. The countertop of claim 1 wherein the finished shaped surface of said solid surface component is finished to form an arcuate surface.

3. The countertop of claim 1 wherein the face element of said vertical joined edge piece is comprised of luminescent solid surface material.

4. The countertop of claim 1 wherein said finished end piece is further comprised of a second corner element affixed to said vertical joined edge piece distally from said first corner element.

5. The countertop of claim 2 wherein said finished end piece is further comprised of a second corner element affixed to said vertical joined edge piece distally from said first corner element.

6. The countertop of claim 3 wherein said finished end piece is further comprised of a second corner element affixed to said vertical joined edge piece distally from said first corner element.

7. The countertop of claim 4 wherein the finished shaped surface of said solid surface component comprising said second corner element is finished to form an arcuate surface.

8. The countertop of claim 5 wherein the finished shaped surface of said solid surface component comprising said second corner element is finished to form an arcuate surface.

9. The countertop of claim 6 wherein the finished shaped surface of said solid surface component comprising said second corner element is finished to form an arcuate surface.

* * * * *